United States Patent [19]

Hanyu et al.

[11] Patent Number: 4,501,210

[45] Date of Patent: Feb. 26, 1985

[54] ELECTRODE CONTROL SEWING MACHINE

[75] Inventors: Susumu Hanyu; Kenji Kato, both of Tokyo, Japan

[73] Assignee: Janome Sewing Machine Co. Ltd., Tokyo, Japan

[21] Appl. No.: 313,986

[22] Filed: Oct. 22, 1981

Related U.S. Application Data

[63] Continuation of Ser. No. 188,599, Sep. 19, 1980, abandoned.

[30] Foreign Application Priority Data

Sep. 27, 1979 [JP] Japan ..... 54-123134

[51] Int. Cl.[3] ..... D05B 3/02

[52] U.S. Cl. ..... 112/158 E; 112/220; 112/277

[58] Field of Search ..... 112/158 E, 220, 221, 112/275, 277, 121.11, 121.12

[56] References Cited

U.S. PATENT DOCUMENTS

| | | | |
|---|---|---|---|
| 4,078,506 | 3/1978 | Sasaki | 112/277 X |
| 4,098,206 | 7/1978 | Suchsland et al. | 112/220 |
| 4,138,955 | 2/1979 | Garron | 112/158 E |
| 4,261,271 | 4/1981 | Makabe et al. | 112/158 E |
| 4,262,614 | 4/1981 | Sugaya et al. | 112/158 E |

*Primary Examiner*—Peter P. Nerbun

*Attorney, Agent, or Firm*—Michael J. Striker

[57] ABSTRACT

In a micro-computer controlled sewing machine a conversion switch is provided which can be switched between a first position and a second position. A manually operable controller, such as a foot pedal, is connected to the conversion switch. The circuit means connects the conversion switch to the micro-computer in the electronic sewing machine. When the conversion switch is in its first position, the operable machine controller will control the rotation speed of the sewing machine. When the conversion is in the second position, the manually operable controller will control the needle swing amplitude.

4 Claims, 5 Drawing Figures

(1) Start (2) Controller is ON (3) Contact elements L are at the upper position (4) Speed control by controller (5) Control of needle swinging amplitude by operating dial (6) Constant low speed control (7) Control of needle swinging amplitude by controller (8) Speed control by operating dial

ELECTRODE CONTROL SEWING MACHINE

This is a continuation of application Ser. No. 188,599 filed Sept. 19, 1980, now abandoned.

BACKGROUND OF THE INVENTION

The invention relates to a sewing machine having an electonic memory storing stitch control data which are sequentially read out from the memory during each rotation of the upper shaft of the sewing machine to control the needle and the feed mechanism and thereby produce a pattern of stitches. More particularly, the invention relates to a sewing machine in which a speed regulating controller can be switched to control the lateral swinging amplitude of the needle.

Generally, an electronic sewing machine has a dial knob provided on the front face of the sewing machine, the dial is manually operated to adjust the swinging amplitude of the needle. Such a dial knob can be inconvenient for manual operation such as in the case of embroidery stitching, in which the machine operator is required to freely operate the dial knob while stitching the embroidery. In this case a large lever is preferable. However, it is very difficult to provide such a lever on the front face of a multi-function sewing machine in view of the mounting space, and in view of the structural problem as to the connection between the lever and the printed-circuit electronic elements. At all events, it is not preferable to carryout a stitching operation in a manner that the machine operator manipulates the fabric to be sewn with one hand while operating the needle regulating knob or lever by the other hand.

SUMMARY OF THE INVENTION

The present invention has been provided to eliminate the foregoing defects and disadvantages of the prior art. It is a basic object of the invention to provide a sewing machine having a speed regulating controller which can be switched to control the needle swinging movement. It is another object of the invention to fix the speed of the sewing machine at a predetermined speed when the speed regulating controller is so switched.

It is still another object of the invention to provide a sewing machine of a simple structure and easy operability.

Many other features and advantages of the invention will be apparent from the following description of the preferred embodiments in reference to the attached drawings.

DETAILED DESCRIPTION OF PREFERRED EMBODIMENTS

Figure 1:
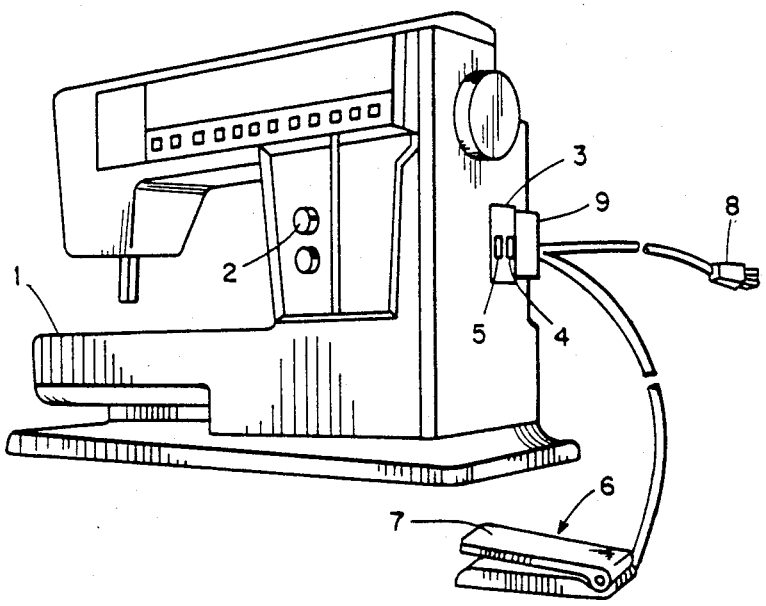
FIG. 1 is the exterior of a sewing machine which uses the invention.

In FIG. 1, the numeral 1 shows a machine housing having a dial 2 provided on the front face thereof for adjusting the stitch width. When the dial 2 is not operated, the stitch width is automatically set in accordance to a standard width specific to a selected stitch pattern. When dial 2 is pushed and then rotated, the stitch width of the pattern is enlarged or reduced proportionally. The numeral 3 is a plug receptacle provided on one side of the machine housing 1 and furnished with a power switch 4 and a conversion switch 5. The numeral 6 is a pedal controller having a foot operated step plate 7. The numeral 8 is a male plug connected to a connector 9 for connecting the controller 6 and a later mentioned control circuit installed within the machine housing 1.

Figure 2:
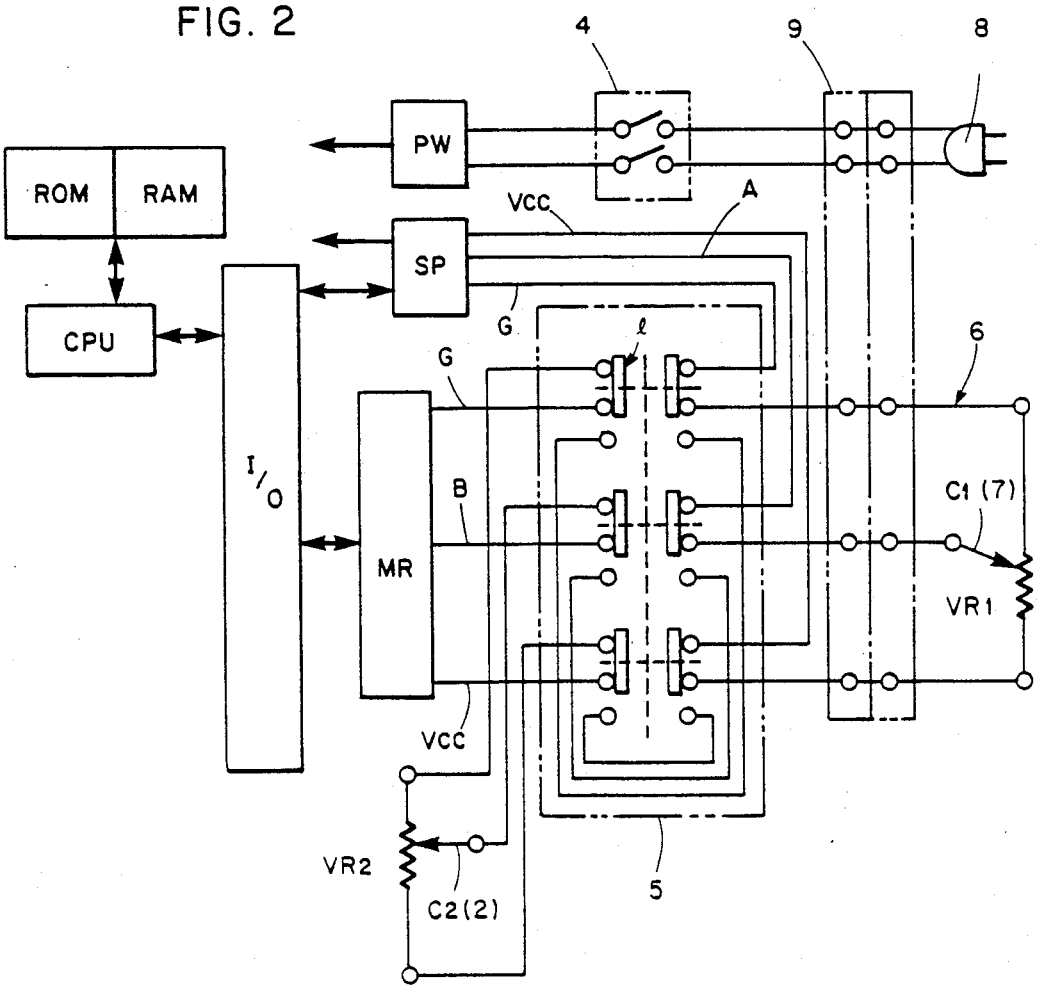
FIG. 2 is a circuit diagram of the invention.

In FIG. 2, ROM is a read-only-memory storing stitch pattern control signals and program control signals. CPU is a central processing unit for executing programs. RAM is a random-access-memory for temporarily storing the results and processes of the programs. I/O is an input-output port. ROM, CPU, RAM and I/O constitute a micro computer. PW is a power supply receives AC power from the plug 8 via the power switch 4, and serves as a power source for a machine motor (not shown) and as a power source for the respective circuit elements. SP is a speed control circuit which gives a control signal Vcc to the controller 6 when a group of vertically movable contact elements L are located at their upper positions in the conversion switch 5, and receives at its line A a signal from a wiper C1 of variable resistor VR1. Thus the speed control circuit SP is turned on together with variable resistor VR1, and the speed of the machine drive motor (not shown) is regulated by moving the wiper C1 along the variable resistor VR1 and, at the same time, the positional signal from the wiper C1 is transmitted to the CPU. MR is a stitch width control circuit which is connected to a variable resistor VR2. Variable resistor VR2 is adjusted by means of a dial 2 when the group of contact elements L in the conversion switch 5 are located at the upper positions as shown. The circuit MR and the variable resistor VR2 are turned on when the line B receives the control signal Vcc, and the initial signal from wiper C2 is transmitted to the central processing unit CPU. Thus the stitch width is adjusted by moving the wiper C2 along the variable resistor VR2. The speed control circuit SP and the line G, G of the manually adjustable stitch width control circuit MR are grounded. When the group of contact elements L of the conversion switch 5 are shifted from the upper position to the lower position, the speed control circuit SP is turned off since its input is disconnected and the stitch width control circuit MR is disconnected from the variable resistor VR2 which is manipulated by the control dial 2. As a result, the control function of the variable resistor VR1 by the controller 6 is enabled. Then the micro-computer CPU detects that the speed control circuit SP is seperated from the controller 6, and causes circuit SP to operate the machine drive motor at a predetermined lowspeed. The numeral 9 denotes the connector shown in FIG. 1.

Figure 3:
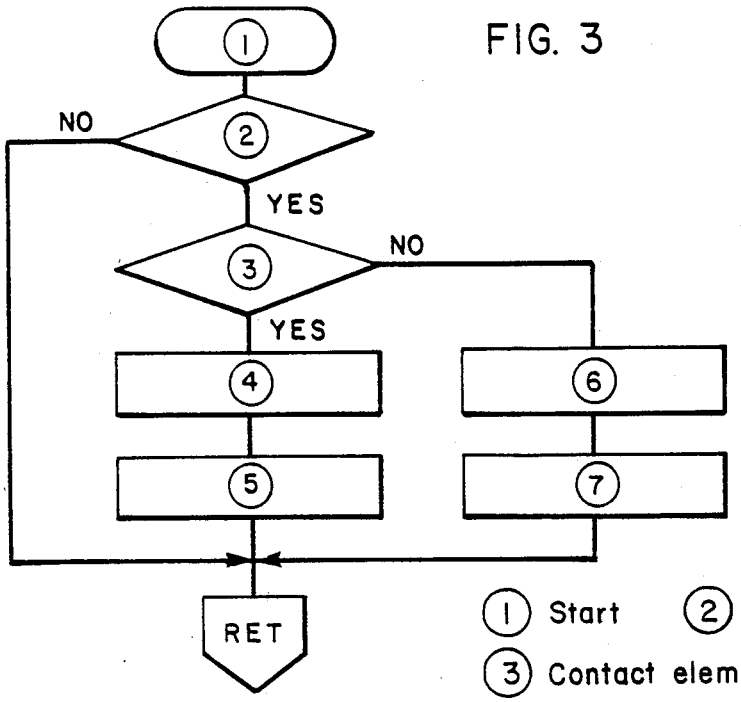
FIG. 3 is a flow chart of a program executed by the invention.

Operation of the above mentioned circuit structure will be explained with reference to the flow chart in FIG. 3. When plug 8 is inserted in a wall socket and the power switch 4 is closed, the program control is started, and it is determined whether or not the step plate 7 of the controller 6 is depressed. That is to say, CPU detects, through the speed control circuit SP or the stitch width control circuit MR, a signal at the initial contact of the wiper C1 which is issued to the variable resistor VR1 when the controller 6 is operated. At the same time, the wiper C1 receives the control signal Vcc. Then the CPU to determines whether the group of contact elements L of the conversion switch 5 are located at their upper position or at their lower position as seen in FIG. 2, which is determined by the fact that the signal has passed through the speed control circuit SP or the stitch width control circuit MR. If the group of contact elements L are located at the upper position, the connections of the elements are as shown in FIG. 2 is provided, and the speed control circuit SP is connected to the controller 6, and controller 6 regulates the rotation speed of the machine drive motor (not shown) in accordance with the position of the wiper C1 relative to the variable resistor VR1 by operation of the step plate 7. On the other hand, the stitch width control circuit MR is made operative when dial 2 is pushed. When the dial 2 is rotated, the wiper C2 is displaced along the variable resistor VR2 and the stitch width is manually controlled, and then the program is returned to the start (RET). When the group of contact elements L are located at the lower position, the variable resistor VR1 of the controller 5 is isolated from the speed control circuit SP, and the stitch width control circuit MR is connected to the variable resistor VR1. When the step plate 7 of the controller 6 is depressed the speed control circuit SP is adjust by CPU to rotate the machine motor at a predetermined low speed. At this time the controller 6 controls the stitches, that is when the wiper C1 is displaced along the variable resistor VR1, it acts on the stitch width control circuit MR for controlling the stitch width.

Figure 4:
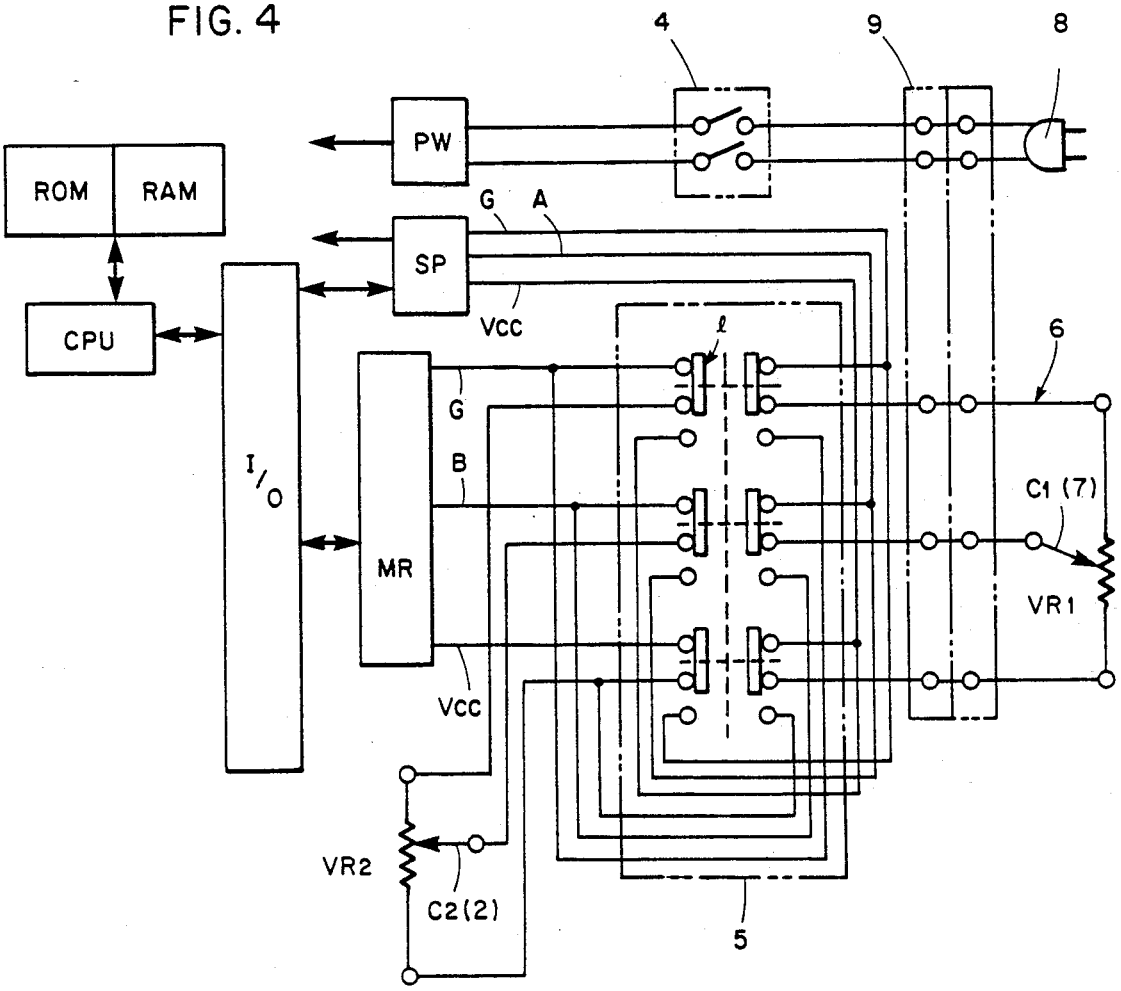
FIG. 4 is a circuit diagram of another embodiment of the invention.

FIG. 4 shows another embodiment of the invention. In FIG. 2, if the group of contact elements L, are located at the lower position, the variable resistor VR2 is cut off. On the other hand if the group of contact elements L in the second embodiment moved to their lower position, the variable resistor VR2 is connected to the speed control circuit SP, so that the rotation speed of the sewing machine may be determined by the resistance value of the variable resistor VR2. When the group of contact elements L are located at the upper position, the effect is the same as in the first embodiment in FIG. 2.

Figure 5:
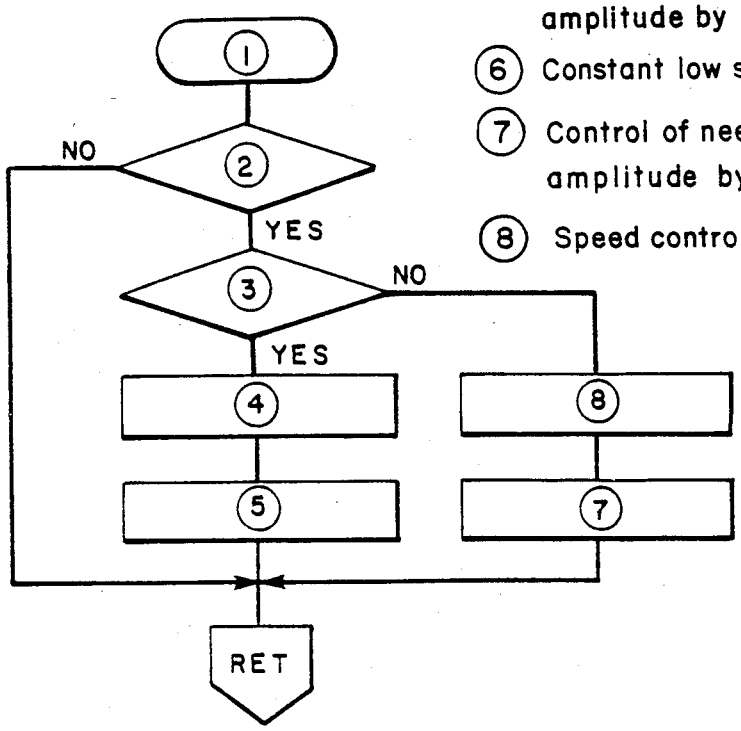
FIG. 5 is a flow chart of a program executed by the second embodiment of the invention.

Operation of the circuit structure shown in FIG. 4 will be explained with reference to the flow chart in FIG. 5. When the program control is started by closing the source switch 4, the effect is the same with the first embodiment in FIG. 2 as to the detection, of the upper and lower positions of the contact elements L by the CPU, and the operation modes switch in dependence upon the positions of the contact elements L. However, in this embodiment, the speed control circuit SP is connected to the variable resistor VR2 which is operated by the dial 2, when the contact elements L are located at the lower position. Therefore, the resistance value of the variable resistor VR2 determines the rotation speed of the sewing machine when the controller 6 is switched to controlling the stitch width.

What is claimed is:

1. An improvement to a micro-computer controlled sewing machine having a dial manually operated to adjust a needle swinging amplitude and a machine controller adjustably operated to control the rotation speed of the sewing machine, the improvement comprising: a conversion switch connected to the dial and to the machine controller and having a first position and a second position; and means connected to the conversion switch and to the micro-computer and operating in a manner that when the conversion switch is in the first position, the machine controller will control the rotation speed of the sewing machine and when the conversion switch is in the second position, the machine controller will control the needle swinging amplitude.

2. The improvement as defined in claim 1, wherein the machine controller is a foot-operated controller.

3. The improvement as defined in claim 1, wherein the conversion switch is so formed as to nullify the function of the dial and causes the mircro-computer to set a predetermined rotation speed of the sewing machine when the conversion switch is in the second position.

4. The improvement as defined in claim 1, wherein the conversion switch is so formed as to convert the needle swing adjusting dial to a speed control dial of the sewing machine when the conversion switch is in the second position.

* * * * *